US006783595B2

(12) United States Patent
Segner et al.

(10) Patent No.: US 6,783,595 B2
(45) Date of Patent: Aug. 31, 2004

(54) POWDER COATING COMPARTMENT COMPRISING AT LEAST ONE MANUAL COATING STATION

(75) Inventors: Johannes Segner, Ravensburg (DE); Hanspeter Dietrich, Rüthi (CH); Leopold Von Keudell, Salem (DE)

(73) Assignee: J. Wagner AG, Altstatten (CH)

( * ) Notice: Subject to any disclaimer, the term of this patent is extended or adjusted under 35 U.S.C. 154(b) by 0 days.

(21) Appl. No.: 10/305,270

(22) Filed: Nov. 26, 2002

(65) Prior Publication Data

US 2003/0145787 A1 Aug. 7, 2003

(30) Foreign Application Priority Data

Nov. 30, 2001 (DE) ..... 101 58 826

(51) Int. Cl.[7] ..... B05B 15/12

(52) U.S. Cl. ..... 118/326; 454/50; 118/310; 118/314

(58) Field of Search ..... 118/326, 313, 118/309, 310, 314, 316, 323; 454/50; 427/421, 424

(56) References Cited

U.S. PATENT DOCUMENTS 418,255 A * 12/1889 Welter ..... 49/193
2,166,534 A * 7/1939 Rosenfeld ..... 16/232
4,495,673 A * 1/1985 Khan ..... 16/232
4,503,582 A * 3/1985 Gurubatham ..... 16/232
4,503,584 A * 3/1985 Malchow ..... 16/232
4,811,518 A * 3/1989 Ladisa ..... 49/193
5,983,453 A * 11/1999 Miwa ..... 16/231
6,187,098 B1 * 2/2001 Kramer et al. ..... 118/326

FOREIGN PATENT DOCUMENTS

CH 270902 1/1903
EP 789 628 B1 10/1995

* cited by examiner

*Primary Examiner*—Richard Crispinio
*Assistant Examiner*—Michelle Acevedo Lazor
(74) *Attorney, Agent, or Firm*—Faegre & Benson LLP

(57) ABSTRACT

In a powder coating compartment having at least one manual coating station which is located outside the compartment in front of an aperture in an end wall for the entry and exit of workpieces to be coated, the aperture being designed to be closed by a door which is disposed for swinging movement at the wall of the compartment and, when fully open, forms a sidewall of the manual coating station, it is provided that the door comprises a door panel adapted to be mounted at either side of the aperture by pivot means designed for quick release of the door from the pivot means.

5 Claims, 9 Drawing Sheets

39
27
63
65
61
55
59
63
65
R
67
69
71

POWDER COATING COMPARTMENT COMPRISING AT LEAST ONE MANUAL COATING STATION

CROSS REFERENCE TO RELATED APPLICATION

The present application claims priority to German patent application 10158826.7, filed Nov. 30, 2001.

BACKGROUND OF THE INVENTION

The instant invention relates to a powder coating compartment comprising at least one manual coating station.

Coating compartments of the kind in question have an interior for spray coating workpieces by means of at least one automatic spraying device. The interior of the compartment is defined by sidewalls and a ceiling which is divided by a gap. The sidewalls have openings for the spraying devices. Workpieces typically are moved through the compartment by a conveyor means. For this reason the compartment usually has an aperture in each of its end walls to allow passage of the workpieces. It is customary to also have an opening for manual coating in the sidewall at the inlet part for workpieces through which opening workpieces may be coated by hand with a spray gun from a manual coating station. If necessary, there may be another opening for manual coating in the sidewall towards the outlet end for workpieces. These openings may be equipped in addition with doors.

During the spray coating procedure vacuum is generated in the interior of the compartment by a suction means so as to prevent powder from escaping from the compartment to the outside.

It is a disadvantage of known compartments that powder particles escape through the relatively big manual coating opening. Although it would be possible to reduce this loss by increasing the suction force accordingly, the consequence would be undesirable flow conditions inside the compartment leading to deterioration of the coating quality.

A known coating compartment of the kind defined in the preamble of claim 1 of EP 789 628 B1 comprises a lock each at its ends adjacent the corresponding apertures for passage of the workpieces. These locks may be converted into precoating and aftercoating stations, respectively. When the compartment needs to be cleaned the locks can be closed tightly by two door flaps mounted permanently at opposite sides so as to be pivotable. The locks thus serve dual functions. The left or right wall of the lock, as seen in the direction of transportation of the workpieces, may be swung open as required so that access to the manual coating station is offered either from the left side or the right side in conveying direction. The roof closure and the bottom are fixedly mounted.

OBJECTS OF THE INVENTION

It is an object of the invention to provide a simpler, space-saving coating compartment which, at the same time, offers great flexibility. This object is met by the present invention. Advantageous embodiments are indicated in the following description. The invention will be described with further details, by way of example, with reference to the accompanying drawings, in which:

DETAILED DESCRIPTION

Figure 1:
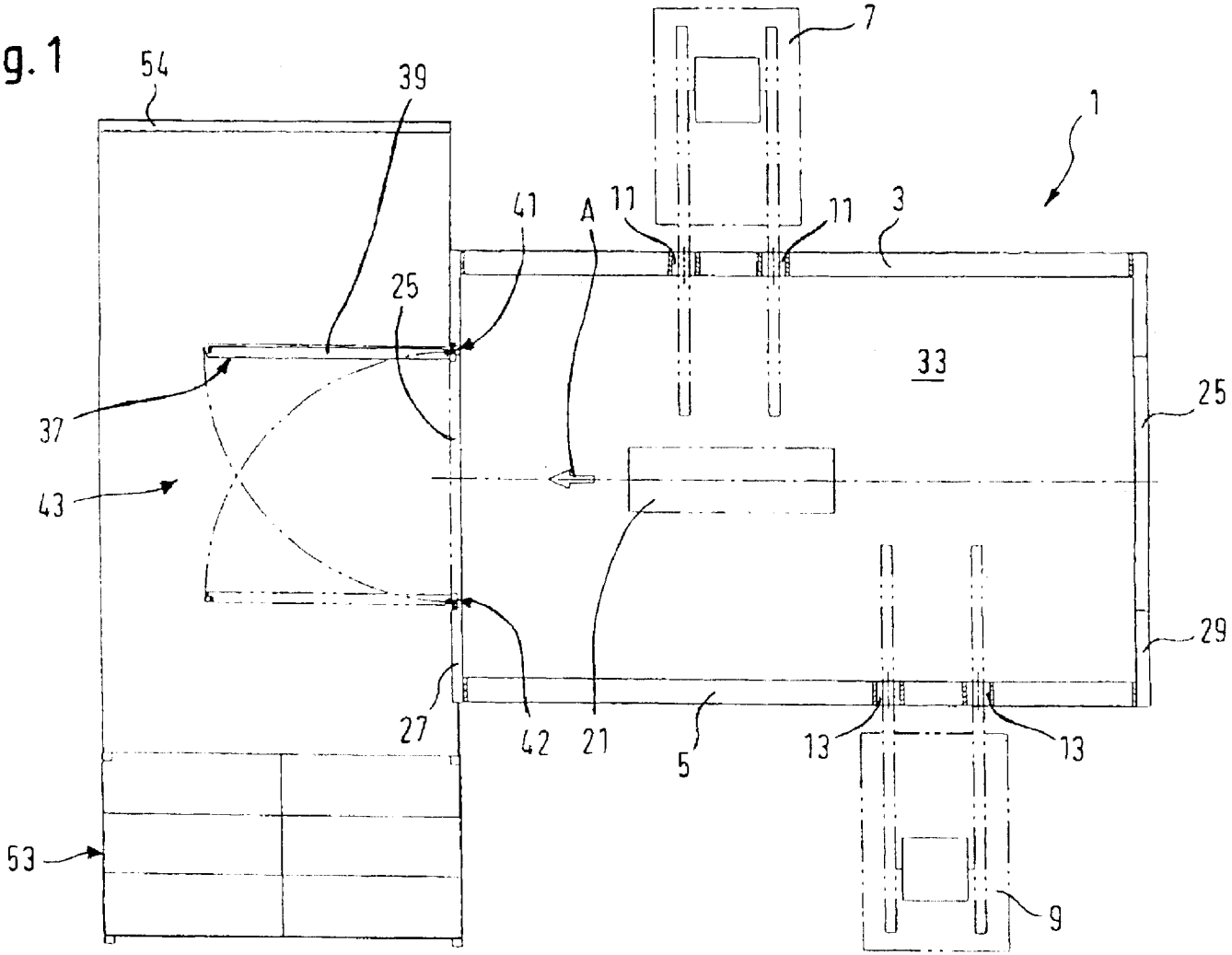
FIG. 1 is a top plan view of the compartment including a manual coating station with an open door and, in dash-dot lines, a second possible position of the open door.

A powder coating compartment 1 comprises two sidewalls 3, 5 formed with openings 11, 13 for at least one automatic spraying device 7, 9 (of which there are two in FIGS. 1 and 2) and further comprises a ceiling 15 and a floor 17. The ceiling 15 of the compartment is interrupted by a gap 19 for purposes of guiding workpieces 21 to be coated by a conveying means.

The end walls 27, 29 of the powder coating compartment 1 are formed with apertures 25 for the workpieces 21. A workpiece 21 is introduced through an aperture 25 into the interior of the powder coating compartment 1. Upon coating, the workpiece 21 is removed from the powder coating compartment 1 through the other aperture 25, as indicated in FIG. 1 by an arrow A which represents the conveying direction.

The apertures 25 are smaller than the respective end wall area defined by the sidewalls 3, 5, the floor 17, and the ceiling 15. Depending on the type of compartment, the floor 17 thereof is designed to comprise a discharge belt or not. The embodiments shown include a discharge belt 32 which is driven by a motor 31. A suction device (not shown) communicates with the lower area of the interior 33 of the compartment. The suction device serves to convey any excess powder from the interior 33 through conduits 35 to a filter recovery unit (not shown).

According to the invention, the aperture 25 for passage of the workpieces can be closed tightly by a door 37. The door 37 has a door panel 39 which is pivotably supported and can be swung open. The door panel 39 may be mounted by pivot means 41, 42 at the two vertical longitudinal edges 40 of the aperture 25. The pivot means 41, 42 are designed for quick release of the door 37 from the end wall 27.

When the door panel 39 is in its open position a manual coating station 43 is formed at the aperture 25. The coating station is defined laterally by the door panel 39 and further by a projecting horizontal ceiling section 45 and a floor section 47 opposite the ceiling section 45. The ceiling and floor sections 45 and 47, respectively, are fixed to the powder coating compartment 1.

Greater flexibility in terms of usefulness of the manual coating station is obtained, in accordance with the invention, by providing the door 37 with a mechanism which permits the pivot axis R of the door 37 to be positioned at the left hand side or at the right hand side, as seen in conveying direction A, of the door 37. In this manner two variations of a manual coating station can be realized without having to rearrange the compartment 1. Moreover, the compartment 1 can be closed by the same door 37 for cleaning purposes.

In FIG. 1, the continuous lines indicating the door 37 of the powder coating compartment 1 show the door in open position at which the door panel is swung around the right hand pivot means 41, as seen in conveying direction A (referred to below as the right hand pivot means 41). In this manner a manual coating station 43 is obtained which is accessible via steps 53 from the left in conveying direction A and which has a platform wall 54 at the right hand side for safety reasons. The manual coating station 43 is so amply dimensioned that the person performing the coating job can reach the workpiece 21 comfortably all around.

If necessary, the door 37 also may be swung around pivot means 42 at the left hand side, as seen in conveying direction A (referred to below as left hand pivot means 42). That is accomplished by first actuating a mechanism for the right hand pivot means 41 so as to unlock the door panel 39 from the right hand pivot means 41, and then actuating a corresponding mechanism for the left hand pivot means 42 for locking the door panel 39 to the left hand pivot means 42. Thereupon the door 37 may be swung open about a pivot axis R at the left hand side as seen in conveying direction A. This additional open position of the door 37 is shown in dash-dot lines in FIGS. 1 and 2. With this position, the workpiece 21 is much better accessible from the other side, the right side in this case.

The door panel 39 may be secured in the open position by a means not specifically shown, such as a hook fastened to the door and an eye disposed on the floor in the area opposite the open door panel 39.

Figure 4:
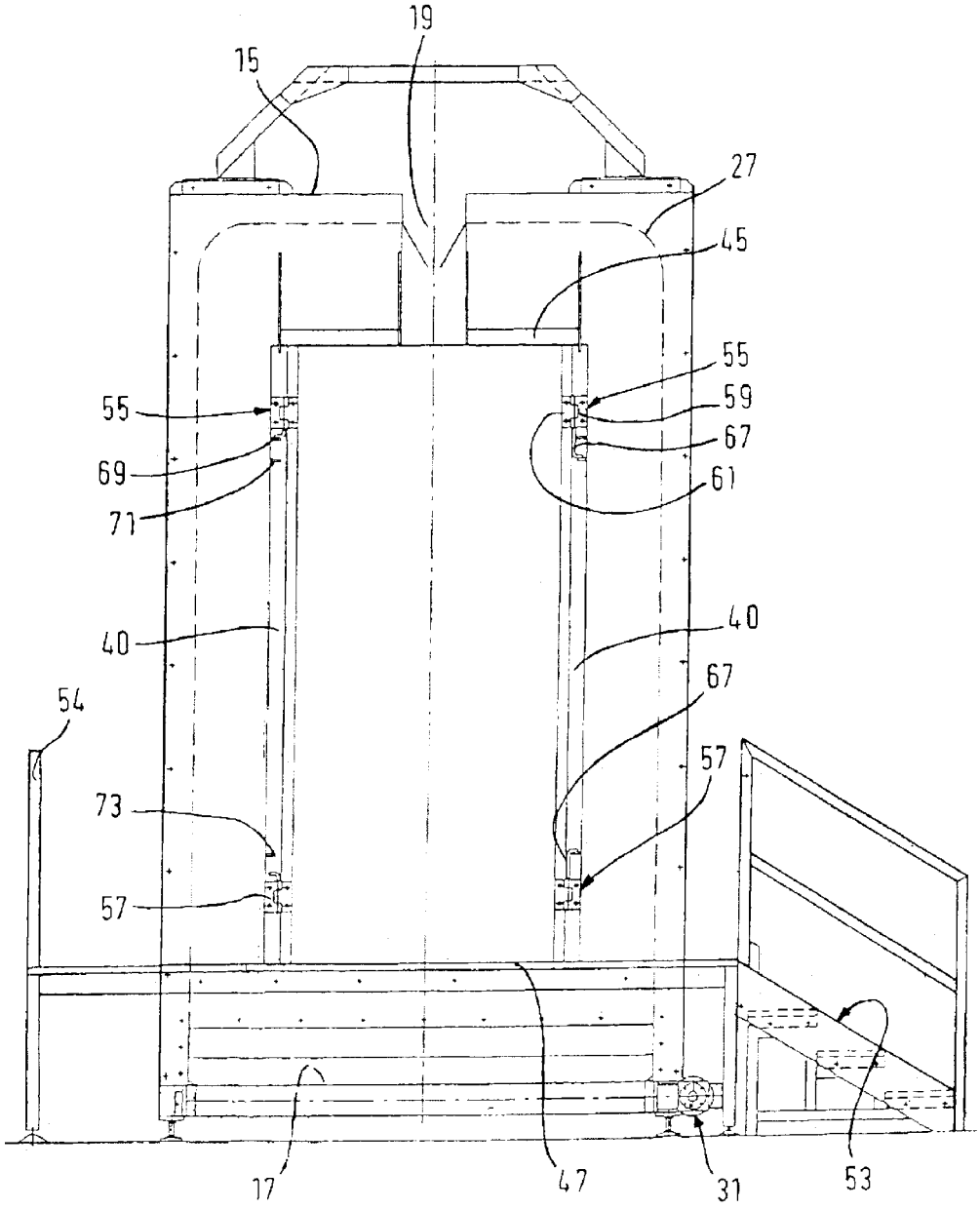
FIG. 4 is a front elevation of the compartment with a closed door.
Figure 5:
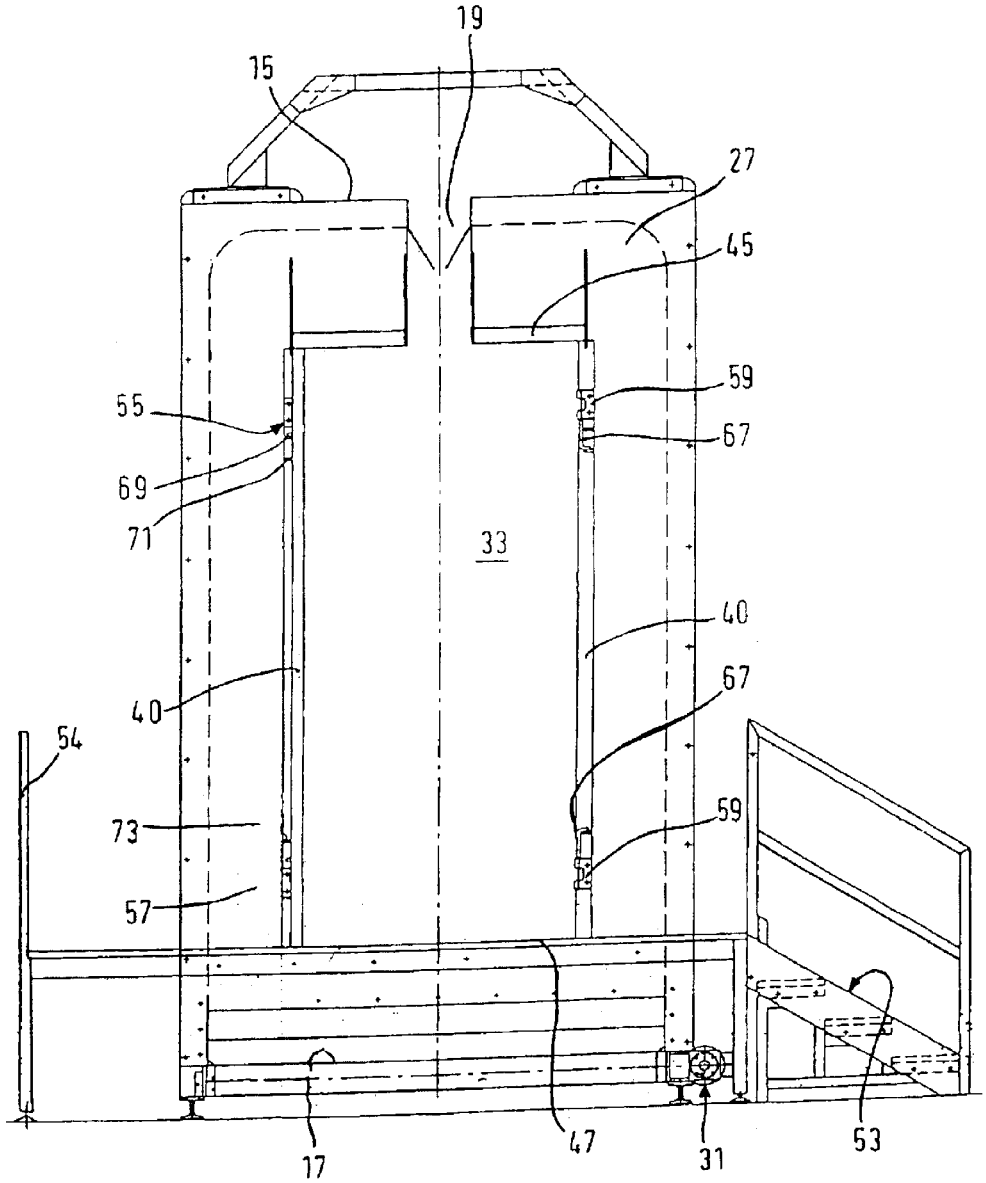
FIG. 5 is a front elevation of the compartment with an open door.
Figure 6:
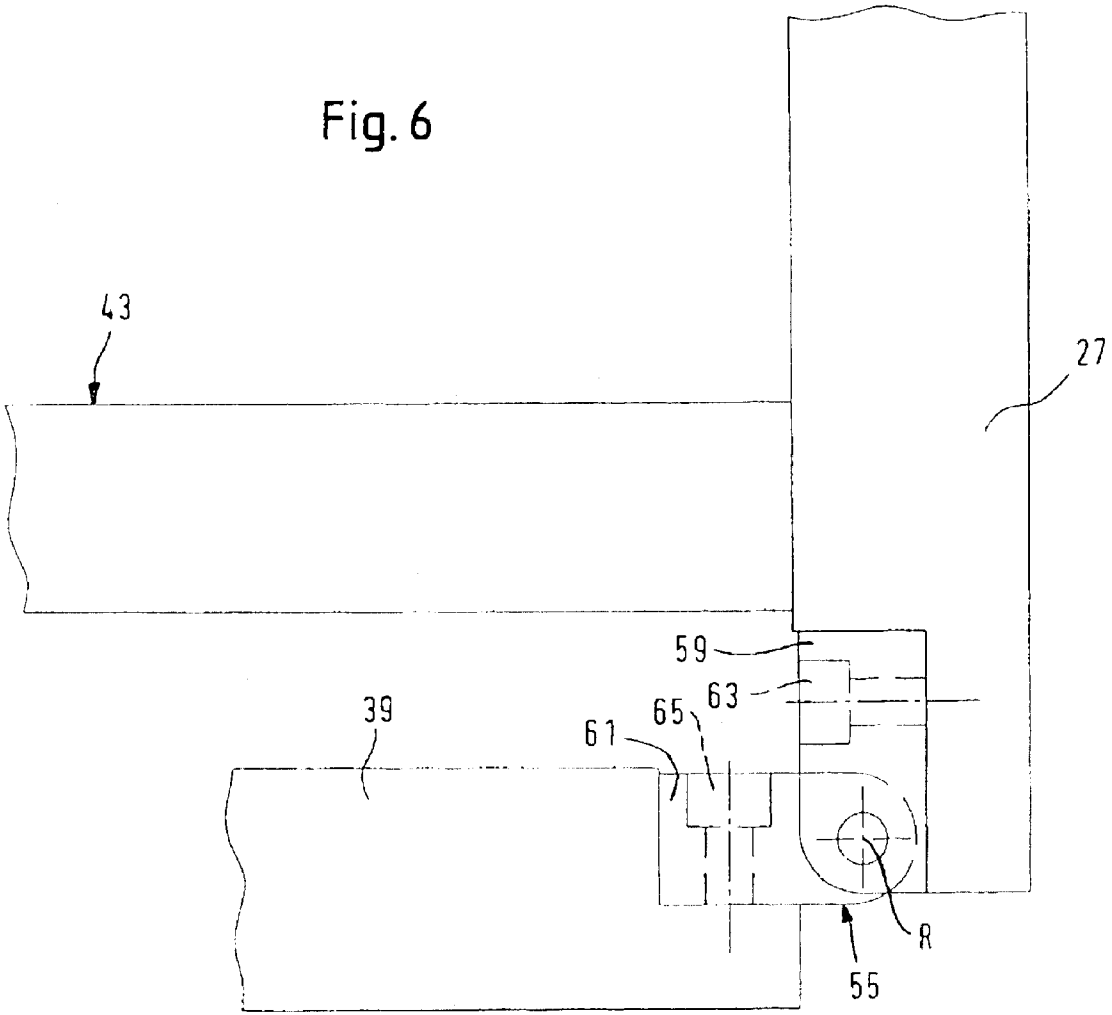
FIG. 6 is a top plan view, on an enlarged scale, showing a hinge when the door is open.
Figure 7:
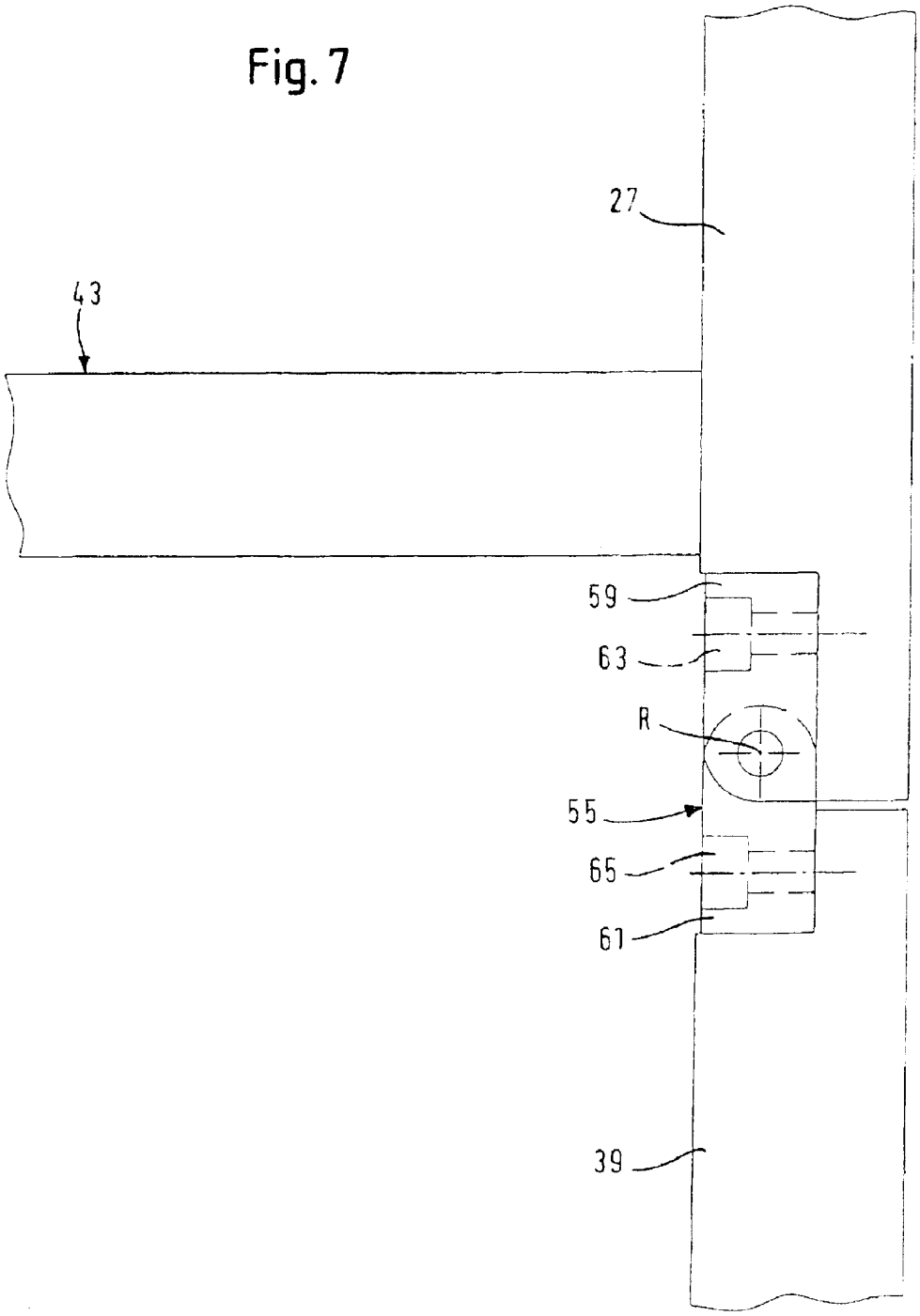
FIG. 7 is a top plan view, on an enlarged scale, showing the hinge when the door is closed.

The pivot means 41 and the mechanism for selectively positioning the pivot axis of the door 37 at the left or right hand sides, as seen in conveying direction A, are illustrated in FIGS. 4 and 5 and shown in greater detail in FIGS. 6 to 9. The pivot means 41 comprise upper and lower hinges 55 and 57, respectively, disposed at the vertical edge of the door panel 39 and the vertical edge 40 of the aperture 25. Each hinge 55, 57 includes two complementary hinge members 59, 61 one, a stationary hinge member 59, being secured to the end wall 27 by screws 63 and a movable hinge member 61 being secured to the door panel 39 by screws 65. Both hinge members 59, 61 are formed with bores which become aligned when the stationary and movable hinge members are put together so that an L-shaped hinge pin 67 may be passed through the same. The long leg of the hinge pin 67 serves as pivot shaft of the hinge 55, 57, while the short leg permits manipulation of the hinge pin 67 and keeps the hinge pin 67 in a defined position with respect to the hinge members 59, 61.

Figure 8:
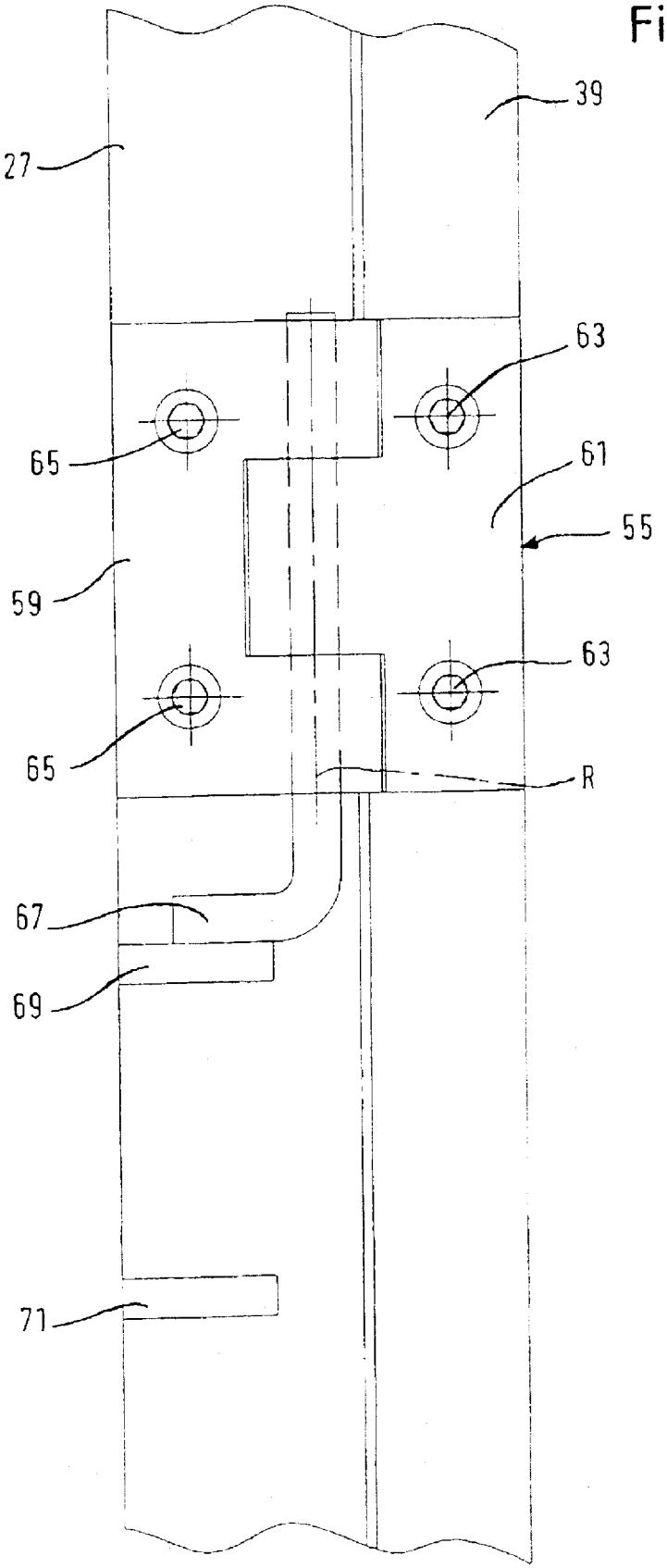
FIG. 8 is a front elevation, on an enlarged scale, showing the hinge in locked position (rotational axis active)
Figure 9:
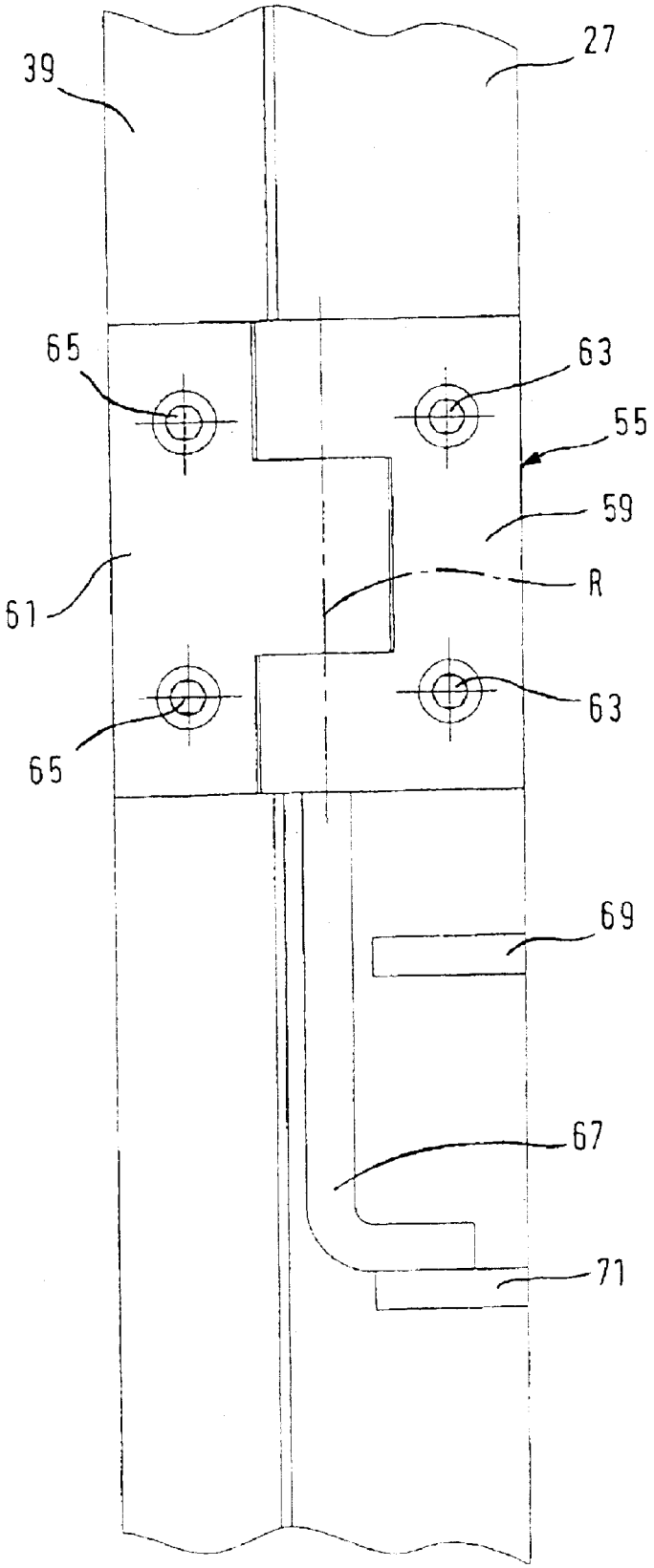
FIG. 9 is a front elevation of the hinge in unlocked position (rotational axis inactive).

The end wall 27 is provided with two stop means 69, 71 (cf. FIGS. 8 and 9) below the upper hinge 55, one 69 of them retaining the short leg of the hinge pin 67 in a position so as to hold together the two hinge members 59, 61 (pivot shaft position; FIG. 8) and the other one 71 retaining the short leg of the hinge pin 67 in a release position (FIG. 9). In the release position, the movable hinge member 61 may be separated from the stationary hinge member 59 so that the door panel 39 at this side of the end wall 27 will become unlocked.

To shift the hinge pin 67 from its pivot shaft position (FIG. 8) into the release position (FIG. 9), the hinge pin 67 is rotated manually about the rotational axis R which coincides with the longitudinal axis of the hinge 55, 57, moving it from the position (FIG. 8) in which it cooperates with the stop means 69 and pushing it downwardly towards the stop means 71. The stop means 71 retains the hinge ping 67 so that it will not get lost when in the release position (FIG. 9).

A corresponding lower stop means 73 disposed above hinge 57 is provided for the lower hinges 57. It will retain the short leg of the hinge pin 67 when the hinge pin 67 has been moved into release position.

The hinge pins 67 for the upper and lower hinges 55 and 57, respectively, may be interconnected so that the door 37 either will be released or locked for pivoting movement by just once manipulating a corresponding mechanism. The door 37 must be in closed position when that is done.

Figure 2:
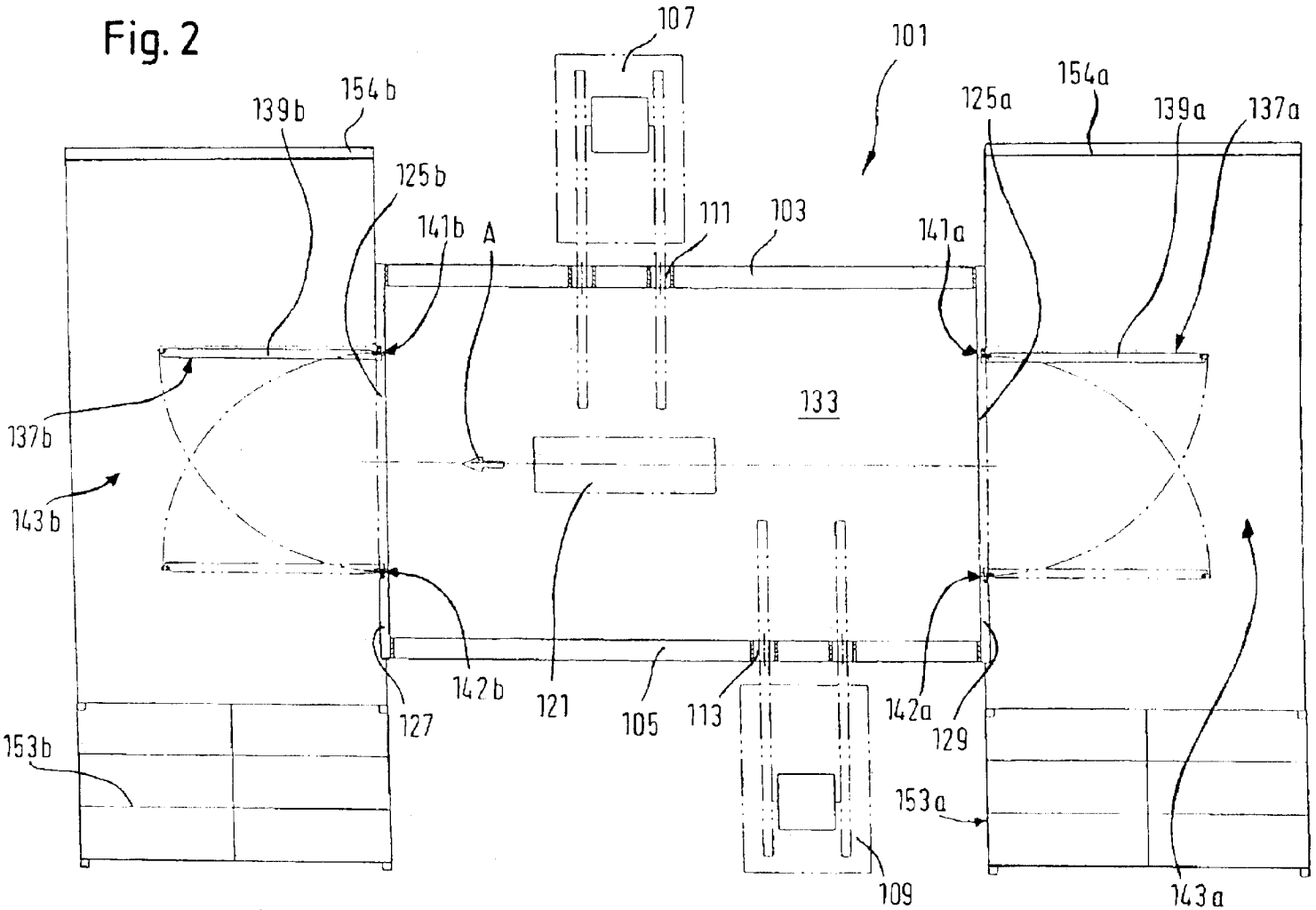
FIG. 2 is a top plan view of the compartment including two manual coating stations with open doors, also showing second possible positions of the open doors in dash-dot lines.

The preferred embodiment of a powder coating compartment 101 is shown in FIG. 2. For ease of understanding, identical or similar structural elements of the powder coating compartment are marked by the same reference numerals in the hundred series. At both end walls 127, 129 the powder coating compartment 101 comprises an aperture 125*a*, 125*b* each.

The workpiece 121 is moved through the powder coating compartment 101 in conveying direction A from the aperture 125*a* at the upstream front end wall 129 to the aperture 125*b* at the downstream rear end wall 127.

Figure 3:
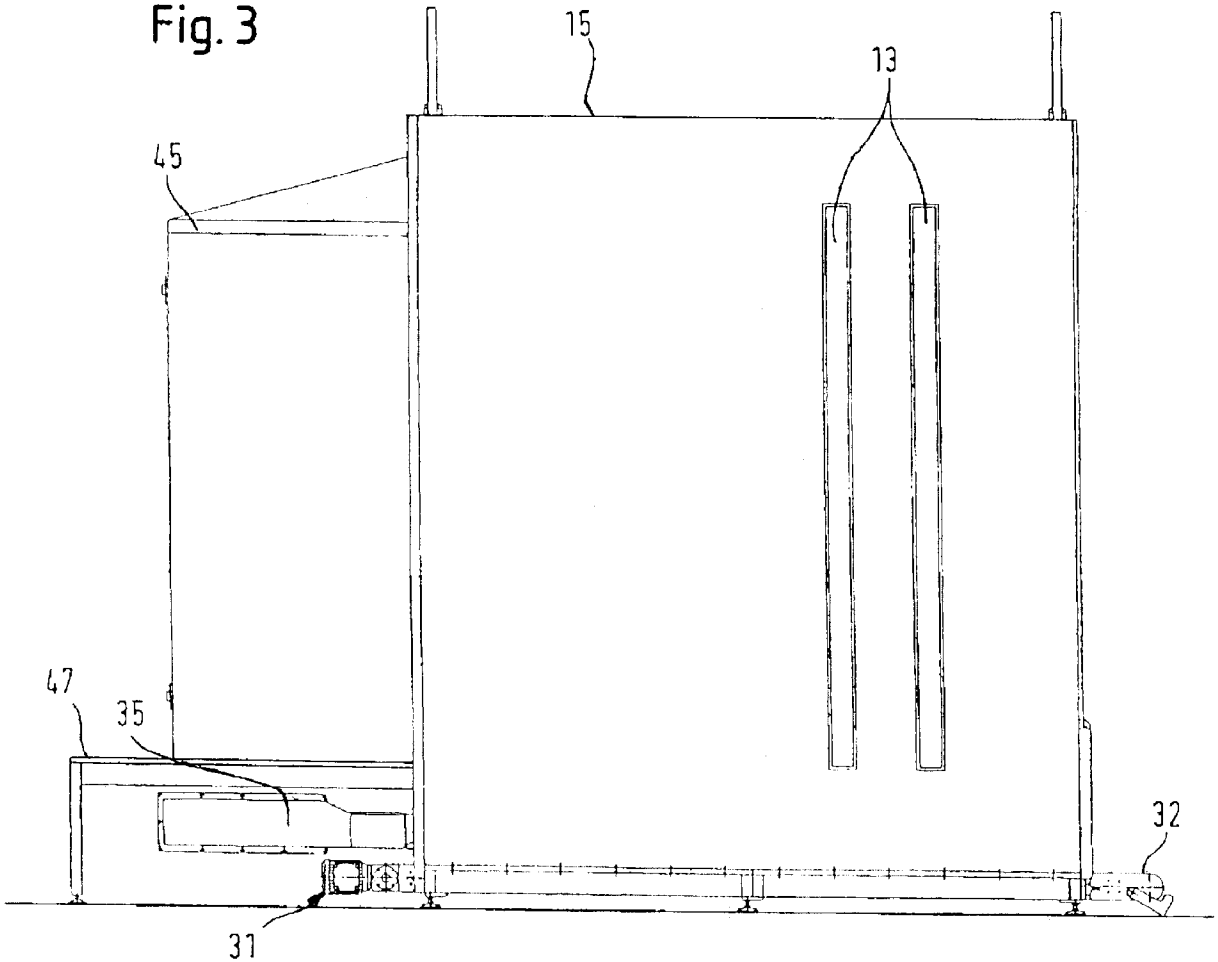
FIG. 3 is a side elevation of the compartment with an open door.

As is the case with the powder coating compartment 1 according to FIG. 1, the powder coating compartment 101, too, comprises a door 137*a*, 137*b* at each aperture 125*a*, 125*b*, the door design being similar to that of the door 37 of the powder coating compartment 1. When the door 137*a*, 137*b* is in its open position the powder coating compartment 101 has a manual coating station 143*a* for pretreatment in front of the upstream end wall 129, as seen in conveying direction A, and a manual coating station 143*b* for after-treatment behind the downstream end wall 127. In correspondence with the embodiment shown in FIGS. 1 and 3, the door 137*a*, 137*b* may be opened by swinging it around two different pivot axes so that the workpiece 121 can be coated with ease from all sides at the manual coating station 143, 143*b*.

What is claimed is:

1. A powder coating compartment comprising at least one manual coating station (43, 143*a*, 143*b*) located outside the compartment (1, 101) in front of an aperture (25, 125*a*, 125*b*) in an end wall (27, 127, 129) for entry and exit of workpieces (21, 121) to be coated, the aperture (25, 125*a*, 125*b*) being designed to be closed by a door (37, 137*a*, 137*b*) which is disposed for swinging movement at the wall of the compartment and, wherein the door is in an open position during operation and when fully open, forms a sidewall of the manual coating station (43, 143*a*, 143*b*), wherein the door (37, 137*a*, 137*b*) comprises a door panel (39, 139*a*, 139*b*) adapted to be mounted at either side of the aperture (25, 125*a*, 125*b*) by pivot means (41, 42, 141*a*, 141*b*, 142*a*, 142*b*) designed for quick release of the door (37, 137*a*, 137*b*) from the pivot means (41, 141*a*, 141*b*) wherein the door panel (39, 139*a*, 139*b*) is adapted to be mounted by hinges (55, 57) each of which comprises complementary hinge members (59, 61) one of which is fixed to the end wall (27, 127, 129) and the other one to the door (39, 139*a*, 139*b*) and a hinge pin (67) which passes through aligned bores in the two hinge members (59, 61) when the latter are assembled and further wherein two stop means (69, 71) for a hinge (55, 57) are provided at the end wall (27, 127, 129), wherein each hinge pin is movable between two positions, with one stop means to retain the hinge pin (67) in a position at which the hinge members (59, 61) are held together and the other stop means to retain the hinge pin (67) in a release position at which the one hinge member (59) is removable from the other one (61), the door (37, 137*a*, 137*b*) thus being separable from the end wall (27, 127, 129).

2. The powder coating compartment as claimed in claim 1, wherein the door (37, 137*a*, 137*b*) is adapted to be secured in a predetermined pivot position, especially in fully open position.

3. The powder coating compartment as claimed in claim 1, wherein a manual coating station (43, 143*a*, 143*b*) each is provided upstream and downstream the interior (33) of the compartment, as seen in a conveying direction (A).

4. The powder coating compartment as claimed in claim 1, wherein a single manual coating station (43) is provided downstream of the interior of the compartment.

5. A powder coating compartment comprising first and second manual coating stations outside of and in line with a workpiece conveying direction through said compartment, the first coating station being provided downstream and the second coating station being provided upstream of said compartment, each station being equipped with a door which is disposed for swinging movement at the wall of the compartment wherein the door is in an open position during operation and, when fully open, forms a sidewall of the manual coating station, wherein the door comprises a door panel adapted to be mounted at either side of the aperture by pivot means designed for quick release of the door from the pivot means wherein the door panel is adapted to be mounted by hinges, each of which includes complementary hinge members, one of which is fixed to an end wall and the other one to the door and a hinge pin which passes through aligned bores in the two hinge members when the latter are assembled and further wherein two stop means for a hinge are provided at the end wall, wherein each hinge pin is movable between two positions by the respective stop means, with one stop means to retain the hinge pin in a position at which the hinge members are held together and the other stop means to retain the hinge pin in a release position at which the one hinge member is removable from the other one, the door thus being separable from the end wall.

* * * * *